US007645052B2

(12) United States Patent
Villard

(10) Patent No.: US 7,645,052 B2
(45) Date of Patent: Jan. 12, 2010

(54) LED CEILING TILE COMBINATION, LED FIXTURE AND CEILING TILE

(75) Inventor: Russell George Villard, Apex, NC (US)

(73) Assignee: CREE, Inc., Durham, NC (US)

( * ) Notice: Subject to any disclaimer, the term of this patent is extended or adjusted under 35 U.S.C. 154(b) by 68 days.

(21) Appl. No.: 11/739,975

(22) Filed: Apr. 25, 2007

(65) Prior Publication Data

US 2008/0266843 A1 Oct. 30, 2008

(51) Int. Cl.
*F21S 8/00* (2006.01)

(52) U.S. Cl. ..... 362/147; 362/145; 362/365

(58) Field of Classification Search ..... 362/145, 362/147, 148, 150, 153, 364, 365, 366, 404, 362/800
See application file for complete search history.

(56) References Cited

U.S. PATENT DOCUMENTS 2,704,835 A * 3/1955 Heller ..... 362/651
6,203,180 B1 * 3/2001 Fleischmann ..... 362/147
6,540,373 B2 * 4/2003 Bailey ..... 362/150
6,997,574 B2 * 2/2006 Kotovsky ..... 362/148
7,246,926 B2 * 7/2007 Harwood ..... 362/364
7,367,685 B2 * 5/2008 Moll ..... 362/133
2007/0263379 A1 * 11/2007 Dowling ..... 362/147
2008/0232116 A1 * 9/2008 Kim ..... 362/365
2009/0147504 A1 * 6/2009 Teeters ..... 362/153

* cited by examiner

*Primary Examiner*—Y My Quach Lee
(74) *Attorney, Agent, or Firm*—Jenkins, Wilson, Taylor & Hunt, P.A.

(57) ABSTRACT

An LED ceiling tile combination is described which includes a ceiling having at least one LED fixture integrated therewith. The LED fixture can include least one LED, and a support structure for the at least one LED strip.

49 Claims, 4 Drawing Sheets

LED CEILING TILE COMBINATION, LED FIXTURE AND CEILING TILE

BACKGROUND

1. Field

Example embodiments in general relate to a combination ceiling tile integrated with a light emitting diode (LED) fixture, a LED fixture and a ceiling tile configured to receive one ore more LED strips thereon.

2. Description of the Related Art

Lighting systems are responsible for about 35 percent of the electricity costs in a typical commercial building and 10 percent in industrial settings. Conventional fluorescent lamps such as T8 lamps with electronic ballast are used for new fixtures and retrofits in typical settings such as commercial office buildings, schools, and in industrial lighting. The inside of a fluorescent lamp includes electrodes and a gas containing argon and mercury vapor. A stream of electrons flows through the ionized gas from one electrode to the other, to collide with the mercury atoms and excite them. As the mercury atoms move from the excited state back to the unexcited state, the atoms give off ultraviolet photons. The photons hit the phosphor coating on the inside of the fluorescent tube, and this phosphor creates visible light photons.

Fluorescent bulbs are fabricated in several sizes, examples including 2', 3', 4' and 8' lengths for straight tubes, and 8" and 12" circular shapes. The straight tubes have a cycle life of about 20,000 hours (7-10 years, on average), whereas the circular bulbs are rated at an average life of about 12,000 hours. The straight tubes are often bundled in sets of 2-4 lamps within a housing known as a troffer that is integrated within a ceiling tile space, typically taking up the space of one or two standard 2'×2' ceiling tile spaces or a single 2'×4' standard ceiling tile space.

However, the use of fluorescent lighting poses several problems. For example, fluorescent lamps require a ballast to stabilize the lamp and to provide the initial striking voltage required to start the arc discharge. Additionally, because the arc is quite long relative to higher-pressure discharge lamps, the amount of light emitted per unit is low, so fluorescent lamps are typically large. Further, some find the color spectrum produced by fluorescent lighting harsh and displeasing.

One common problem is that the mercury inside a fluorescent tube tends to migrate to one end of the tube, leading to only one end of the lamp producing most of the light. Moreover, the disposal of phosphor and the small amounts of mercury in the tubes poses an environmental issue.

Fluorescent lamps typically operate best around room temperature (for example, about 68 degrees Fahrenheit or 20 degrees Celsius). At much lower or higher temperatures, lamp efficiency decreases; at low temperatures (below freezing) standard fluorescent lamps may not start. Special fluorescent lamps are therefore needed for reliable service outdoors in cold weather.

Another common problem with fluorescent lighting is that fluorescent lamps do not give out a steady light. Instead, and particularly toward the end of tube life, the lamps often flicker (fluctuate in intensity) at a rate that depends on the frequency of the driving voltage. While this is not easily discemable by the human eye, it can cause a strobe effect. This annoying "disco strobe" effect is particularly common with fluorescents at the end of tube life. The strobe effect poses a safety hazard in a workshop for example, where something spinning at just the right speed may appear stationary if illuminated solely by a fluorescent lamp.

LEDs are becoming widely used in many consumer lighting applications. In consumer applications, one or more LED dies (or chips) are mounted within a LED package or on an LED module or strip, which may make up part of a lighting fixture which includes one or more power supplies to power the LEDs. The module or strip of a fixture includes a packaging material with metal leads (to the LED dies from outside circuits), a protective housing for the LED dies, a heat sink, or a combination of leads, housing and heat sink. Various implementations of LED fixtures including one or more LED modules, arrays or strips of LEDs are becoming available in the marketplace to fill a wide range of applications, such as area lighting, indoor lighting, backlighting for consumer electronics, etc. LEDs may offer improved light efficiency, a longer lifetime, lower energy consumption, no environmental disposal issues and reduced maintenance costs, as compared to light sources such as T8 fluorescent lamps.

SUMMARY

An example embodiment is directed to an LED ceiling tile combination. The combination may include a ceiling tile having a planar surface, and at least one LED fixture integrated with the ceiling tile so that the fixture is arranged along the same plane of the ceiling tile planar surface.

Another example embodiment is directed to an LED fixture which includes at least one LED strip integrated with a planar surface having a thickness so that the LED strip is arranged along the same plane of the planar surface. The fixture includes a support structure for the at least one LED strip. The planar surface includes an opening through which a part of the support structure extends to secure the LED strip to the backside of the planar surface.

Another example embodiment is directed to a ceiling tile which includes a panel having one of a generally rectangular or square shape. The panel has a thickness, a facing surface, a backside surface and at least one opening formed through its thickness. At least one LED strip is integrated with the ceiling tile so that the LED strip is arranged along the same plane of the ceiling tile facing surface.

Another example embodiment is directed to a ceiling tile having a panel which is configured in one of a generally rectangular or square shape. The panel has a thickness, a facing surface, a backside surface and at least one opening formed through its thickness. A slider mount assembly is affixed within the opening on the facing surface of the panel. The assembly includes a power connector at an end thereof and is configured to receive an LED strip therein. A removable power supply is attached to the power connector.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments.

DETAILED DESCRIPTION OF EXAMPLE EMBODIMENTS

Figure 1:
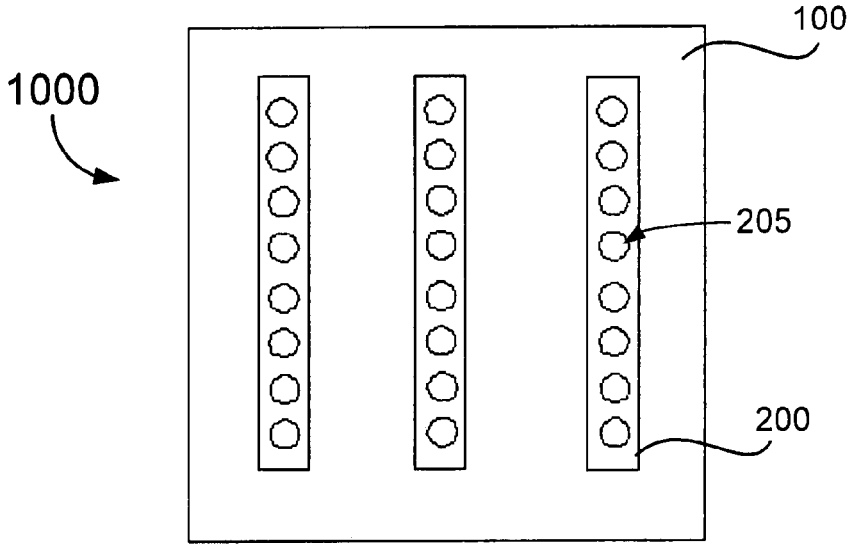
FIG. 1 is a bottom view of an LED ceiling tile combination, illustrating a plurality of LED strips on a facing surface of a ceiling tile.

Example embodiments illustrating various aspects of the present invention will now be described with reference to the figures. As illustrated in the figures, sizes of structures and/or portions of structures may be exaggerated relative to other structures or portions for illustrative purposes only and thus are provided merely to illustrate general structures in accordance with the example embodiments.

Furthermore, various aspects of the example embodiments may be described with reference to a structure or a portion being formed on other structures, portions, or both. For example, a reference to a structure being formed "on" or "above" another structure or portion contemplates that additional structures, portions or both may intervene there between. References to a structure or a portion being formed "on" another structure or portion without an intervening structure or portion may be described herein as being formed "directly on" the structure or portion.

Additionally, relative terms such as "on" or "above" are used to describe one structure's or portion's relationship to another structure or portion as illustrated in the figures. Further, relative terms such as "on" or "above" are intended to encompass different orientations of the device in addition to the orientation depicted in the figures. For example, if a device, fixture or assembly in the figures is turned over, a structure or portion described as "above" other structures or portions would be oriented "below" the other structures or portions. Likewise, if a device, fixture or assembly in the figures is rotated along an axis, a structure or portion described as "above" other structures or portions would be oriented "next to", "left of" or "right of" the other structures or portions.

As used herein, the phrase "building material panel" refers to material panel which is used for a construction purpose, and includes, but is not limited to, ceiling panels, floor panels, wood or laminate flooring, sheetrock, plasterboard, wallboard, T-111 composite materials, brick wall or flooring structure, masonry wall or flooring structure and fiber board.

One type of building material panel is a ceiling tile. Ceiling tiles are lightweight tiles used in the interior of buildings. Ceiling tiles are typically placed on a steel grid and, depending on the tile selected, may provide thermal insulation, sound absorption, enhanced fire protection, and/or improved indoor air quality.

Also referred to as ceiling panels or drop-ceiling tiles, ceiling tiles facilitate access to wiring and plumbing above the ceiling grid, and can be easily changed, removed, or replaced as needed. Ceiling tiles are typically fabricated from perlite, mineral wool, plastic, tin, aluminum, and/or fibers from recycled paper. The tiles frequently include patterns comprised of holes to improve sound absorption properties, although many tiles have a molded surface providing a textured, sculpted, or pressed-tin look to the ceiling. Some tiles are available with decorative photo/transfer surfaces, and other tiles are approved for installation under fire suppression sprinkler heads so the sprinklers do not show, and other types of tiles are approved for use in food preparation areas.

An example combination includes a building material panel such as a ceiling tile which has a plurality of LEDs integrated therein to provide interior lighting. In this example, the ceiling tile can include one or more LED fixtures integrated therewith so that the LEDs are substantially parallel with the planar facing surface of the ceiling tile to provide lighting in the space below. However, the one or more LEDs are not limited to being parallel to the facing surface of the building material panel; the LEDs may be oriented so as to protrude below or out from the facing surface or recessed with respect to the facing surface, at an angle, and/or adjustable to a desired angle or orientation with respect to the facing surface of the building material panel.

The LED fixture includes one or more LEDs mounted on a carrier such as a metal core printed circuit board (MCPCB) strip. Secondary optics or reflectors can be provided over and around the LEDs to shape the total light output of the LED strip. Different LED strips having different LEDs, optics and/or reflector arrangements for different light shapes can be interchangeable within a particular building material panel.

In one example, a combination building material panel with LEDs such as an LED ceiling tile is applicable to indoor lighting applications such as within an office building, home, covered outdoor space, etc. The brightness and/or performance of the LED ceiling tile or LED fixture can be adjusted by adding, subtracting and/or replacing LED strips and/or power supplies attached thereto for driving the LEDs.

FIG. 1 is a bottom view of an LED ceiling tile combination, illustrating a plurality of LED strips on a facing surface of a ceiling tile. As shown in FIG. 1, the combination 1000 includes a ceiling tile 100 which includes a plurality of LED strips 200 thereon. The LED strips 200 are arranged in space relation on a facing surface of the ceiling tile 100 so as to be generally flush with the facing surface. In an example, each of the LED strips 200 are received within openings dimensioned to the size of the LED strip within ceiling tile 100. The incorporation of a plurality of LED strips 200 directly integrated with a ceiling tile 100 eliminates the need for a bulky housing (troffers) that are used in current lighting fixtures for tiled ceilings. Accordingly, the combination 1000 provides an LED light source that is integrated with a normal or standard ceiling tile, such as the 2'×2' or 2'×4 ' ceiling tiles conventionally used in office building environments, home environments, etc.

Figure 2A:
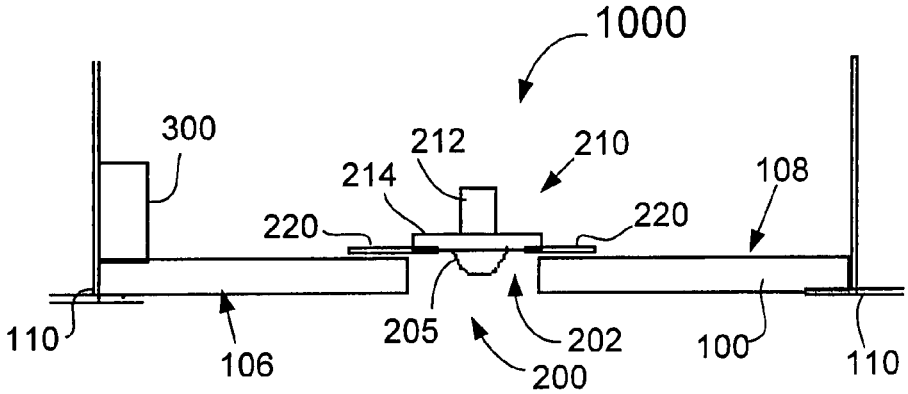
FIG. 2A is a side view of the LED ceiling tile combination.

FIG. 2A is a side view of the LED ceiling tile combination. As shown in FIG. 2A, the LED strip 200 is positioned within an opening 202 formed in the ceiling tile 100. The ceiling tile 100 is supported on tile mounts 110. The LED strip 200, which is also referred to herein occasionally as an LED fixture, includes a mount 210. The LED strip 200 is removably affixed to the mount 210. As previously shown in FIG. 1, each strip 200 includes a plurality of serially-connected LEDs 205 thereon. FIG. 1 illustrates a strip 200 with eight (8) LEDs 205; however the example embodiments are not so limited; each strip 200 can include 10 LEDs, greater than 10 LEDs or fewer than 8 LEDs, for example.

The mount 210 (also occasionally referred to herein as a support structure) includes a T-bar having a horizontal surface 214 to which the LED strip 200 is attached and a vertical leg 212. The T-bar provides a heat spreading function for the LED strip 200 thereon. The mount 210 further includes a pair of metal tabs 220 oriented perpendicular to the T-bar at horizontal surface portion 214 so as to be flush with a backside surface 108 of the ceiling tile 100.

Figure 2B:
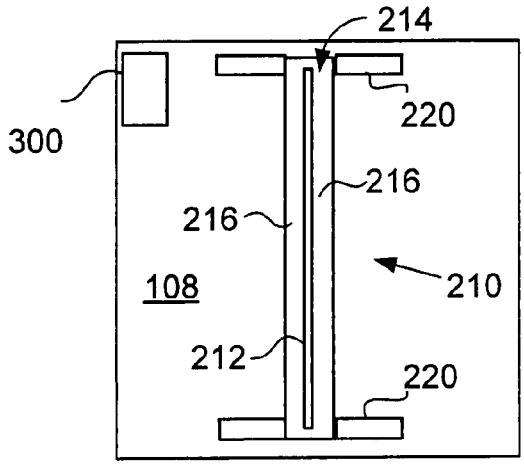
FIG. 2B is a top view of the LED ceiling tile combination illustrating the back surface of the ceiling tile.

FIG. 2B is a top view of the LED ceiling tile combination illustrating the back surface of the ceiling tile. As shown, the mount 210 is positioned on the backside surface 108 such that the vertical leg 212 extends upward and extends generally along a center line of the horizontal surface 214 so as to form a pair of flanges 216. The flanges 216 with vertical leg 212 are rigidly supported on the backside surface 108 by the attached horizontal tabs 220.

FIG. 2B also illustrates a removable power supply 300 which is electrically connected to the LED strip 200 so as to drive the LEDs 205 thereon (wires not shown for clarity). The power supply 300 may be secured to a surface of the ceiling tile 100 with suitable fasteners such as screws, so as to be easily removable. The power supply 300 may be switched out and replaced with any other power supply unit, of any size, so long as it fits within the footprint of the space available on the ceiling tile surface 108, for example.

The power supplies may be constant current drivers 300 which supply constant but adjustable current with variable voltage, depending on the number of LEDs. For example, the driver 300 can drive the LEDs at currents from 350 mA (equivalent to 1 W), yielding at least 80 lumens of light, or up to 1000 mA (equivalent to 4 W), for 176 lumens typical, if more light output is needed. An example power supply 300 can be a switch mode, switching LP 1090 series power supply manufactured by MAGTECH, such as the MAGTECH LP 1090-XXYZ-E series switchmode LED driver, for example. Another example driver could be an ML-350 driver for powering the LEDs 205 on the LED strip 200 at a constant 350 mA current.

The driver 300 has an adjustable voltage range and the type of driver depends on the voltage drop of each of the LEDs 205 in series in the combination LED ceiling tile 1000. The type of power supply 300 used does not matter; a variable power supply such as the LP 1090 can be automatically variable between 90 and 240 volts depending on the particular application for the combination LED ceiling tile.

In the example combination 1000 shown in FIGS. 1-2B, each LED strip 200 can include in one example, ten (10) LEDs 205. In an example, the LEDs 205 can be CREE XRE™ LEDs, which provide about 700 to 900 lumens per individual strip 205. The LEDs 205 are mounted to an MCPCB and then attached to the T-bar of mount 210 with a suitable thermal adhesive and/or mechanically attached with fasteners such as screws.

The LED strip 200 can be attached or otherwise integrated with a standard 2'×2' ceiling tile for example, which can hold approximately 8-10 LED strips 200, producing a total light output in a range between approximately 5,600 to 9,000 lumens per 2'×2' area. A standard 2'×4' ceiling tile can hold approximately 16-20 LED strips 200, producing a total light output in a range between approximately 11,200 up to 18,000 lumens per 2'×4' area.

Any heat buildup is limited due to the LED strips 200 being arranged in spaced relation across the facing surface 106 of the ceiling tile 100, so as to provide desirable air flow between adjacent strips 200. The air flow can be maintained around each strip 200 due in part to the spacing of the mount 210; the thickness of the mount 210 dictates the air flow allowed. In an example, the thickness of the mount 210 can be about ¼". In an alternative, one or more vents (not shown) can be added to the ceiling tile 100 if additional air flow is desired.

If desired, the LEDs 205 may be configured to emit any desired color light. The LEDs 205 may be blue LEDs, green LEDs, red LEDs, different color temperature white LEDs such as warm white or cool or soft white LEDs, and/or varying combinations of one or more of blue, green, red and white LEDs 205. In an example, warm white or cool or soft white LEDs are typically used for indoor area lighting such offices. White LEDs may include a blue LED chip phosphor for wavelength conversion. Additionally, one, some or all LEDs 205 can be fitted with a secondary optic that shapes the light output in a desired shape, such as circle, ellipse, trapezoid or other pattern.

One or more individual LEDs 205 may be slanted at different angles, at the same angles, in groups of angles which differ from group to group, etc. For example, the shape of the light output may be varied by the angle of the LEDs from normal. Accordingly, one, some, or all strips 200 or groups of strips 200 on a ceiling tile, each having LEDs 205 thereon can be mounted at different angles to the planar, facing surface of the ceiling tile 100. Additionally, a given strip 200 may be straight or curved, and may be angled with respect to one or more dimensions. In another example, each LED 205, groups or strips 200 of LEDs may include the same or different secondary optics and/or reflectors.

In other examples, the LED strips 200 can be mounted at varying ranges of angles, and different optical elements or no optical elements may be used with the LED strips 200 mounted at differing ranges of angles. The angles of the LED strips 200 and/or individual LEDs 205 with or without optical elements can be fixed or varied in multiple dimensions. Therefore, one or more LED strips 200 can be set at selected angles (which may be the same or different for given strips 200) to the facing surface of the ceiling tile 100, so as to produce any desired illumination pattern.

Example configurations of angled LEDs 205 or angled LED strips 200 are described in detail in co-pending and commonly assigned U.S. patent application Ser. No. 11/519,058, to VILLARD et al, filed Sep. 12, 2006 and entitled "LED LIGHTING FIXTURE", the relevant portions describing the various mounting angles of LED strips 200 and/or LEDs 205 being hereby incorporated in its entirety by reference herein.

Figure 3A:
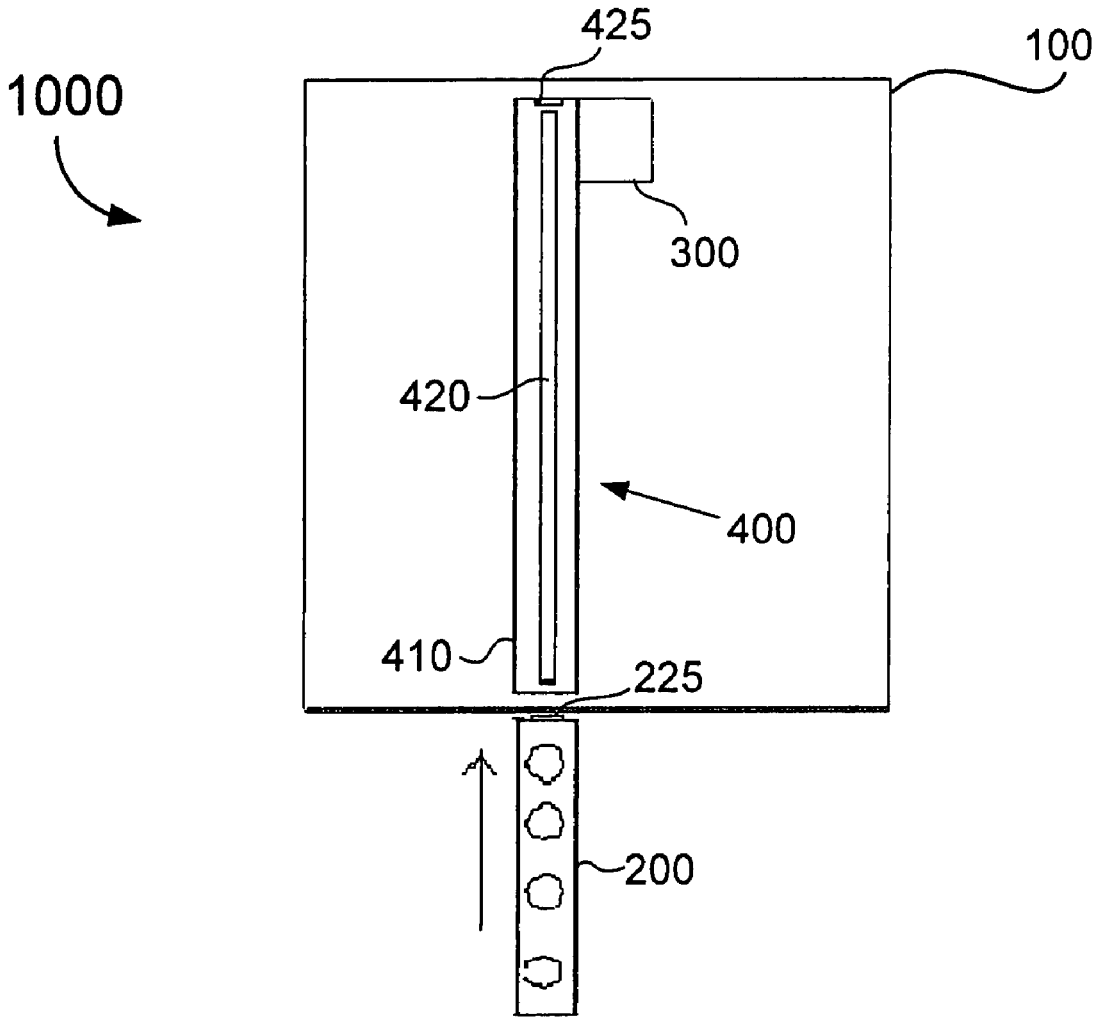
FIG. 3A is a bottom view of the LED ceiling tile combination illustrating a sleeve mount for receiving a removable LED strip.
Figure 3B:
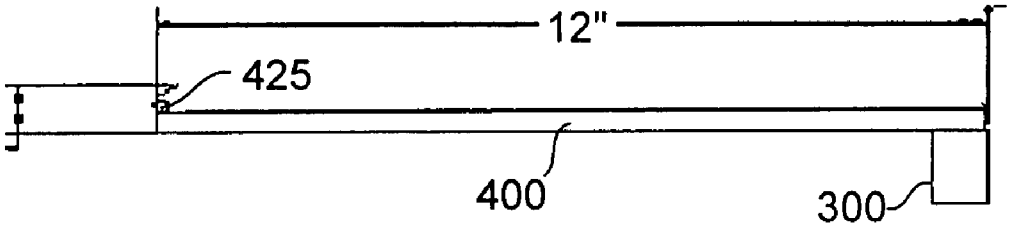
FIG. 3B is a side view of the sleeve mount illustrating a power connector and a removable power supply attached thereto.

FIG. 3A is a bottom view of the LED ceiling tile combination illustrating a sleeve for receiving a removable LED strip, and FIG. 3B is a side view of the sleeve illustrating a power connector and a removable power supply attached thereto. FIGS. 3A and 3B illustrate how various LED strips 200 can be removably attached to a given ceiling tile 100, for example. As shown in FIG. 3A, each ceiling tile 100 can include a slider mount assembly embodied as a sleeve 400 that enables removal and replacement of a given LED strip 200 in the ceiling tile 100. Although described in the context of a ceiling tile in this example, the sleeve 400 is applicable to any building material panel as heretofore described.

The sleeve 400 includes a mount body 410 which is configured to receive the LED strip in slidable relation thereon. The mount body 410 includes a slot 420 for receiving the vertical leg 212 of the T-bar in which the LED strip 200 is affixed.

A plastic sleeve 400 is merely one example, the slider bracket assembly can be made of other materials such as aluminum, copper, ceramic, etc. As shown in FIG. 3B, the sleeve 400 includes a power connector 425 configured to receive a corresponding power connector 225 at the end of an LED strip 200. Additionally, a power supply (driver) 300 can be attached to a backside surface of the sleeve 400 for electrical connection to an LED strip 200 therein. In an example, the length of the sleeve 400 can be approximately 12" to support a 12" long LED strip 200 therein; however these are only example dimensions, the sleeve 400 and/or the LED strip 200 receivable therein can be longer or shorter depending on the desired lighting coverage of the LED ceiling tile combination 1000.

The slot 420 provides access for the leg 212 of the T-bar and is used to provide sound thermal conduction for the LED fixture 200. To install an LED strip 200 into the sleeve 400, the LED strip 200 can be tilted and slid in to snap into the mount body 410 such that the power connectors 225 and 425 engage for electrical connectivity. Accordingly, an LED strip 200 would slip and snap into the plastic sleeve 400. In an alternative, ceiling tiles 100 can be manufactured and sold with an installed sleeve 400 with our without the driver 300 attached thereto.

Figure 4:
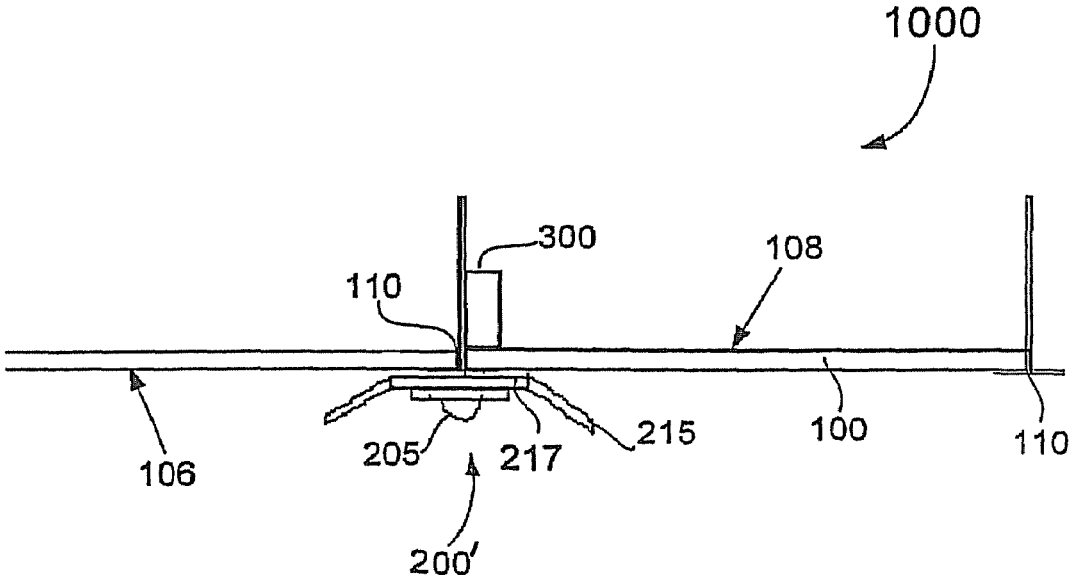
FIG. 4 is a side view of another embodiment of the LED ceiling tile combination illustrating an LED strip affixed to a ceiling tile mount between adjacent ceiling tiles.
Figure 5:
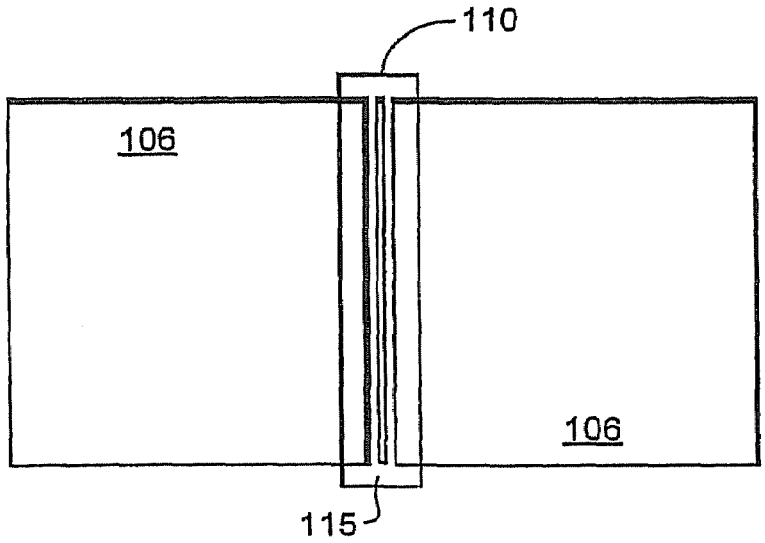
FIG. 5 is a bottom view illustrating the surface of the ceiling tile mount oriented between two adjacent ceiling tiles.

FIG. 4 is a side view of the LED ceiling tile combination in accordance with another example embodiment; and FIG. 5 is a bottom view illustrating the surface of a ceiling tile mount 110 oriented between two adjacent ceiling tiles 100. Referring to FIGS. 4 and 5, in an alternative example an LED strip 200' can be attached directly or indirectly to a ceiling mount 110 between adjacent ceiling tiles 100. FIG. 4 thus shows the LED ceiling tile combination 1000 in such a configuration. If desired, as the ceiling tile mounts 110 are typically made of a metal such as steel, the mount 110 can be provided with additional surface area such as a flat horizontal surface 217 which extends a substantial portion of the length of the ceiling tiles 100. The surface 217 includes a pair of fins or wings 215 attached thereto. This additional surface area may be added to improve thermal conductive properties of the LED strip 200. In an example, surface 217 and wings 215 may be composed of aluminum, copper or other material having sound thermal conductive properties.

Additionally, the removable power supply 300 in FIG. 4 is shown in a vertical orientation. Accordingly, the power supply 300 can be mounted in a vertical or horizontal orientation on the backside surface 108 of the ceiling tile 100, and/or adjacent to a ceiling tile mount 110 as is shown in FIG. 4. FIG. 5 more clearly illustrates the orientation of the surface 115 of the ceiling tile mount 110 between adjacent ceiling tiles 100. FIG. 5 does not show the placement of an LED strip 200 thereon for purposes of clarity.

Figure 6A:
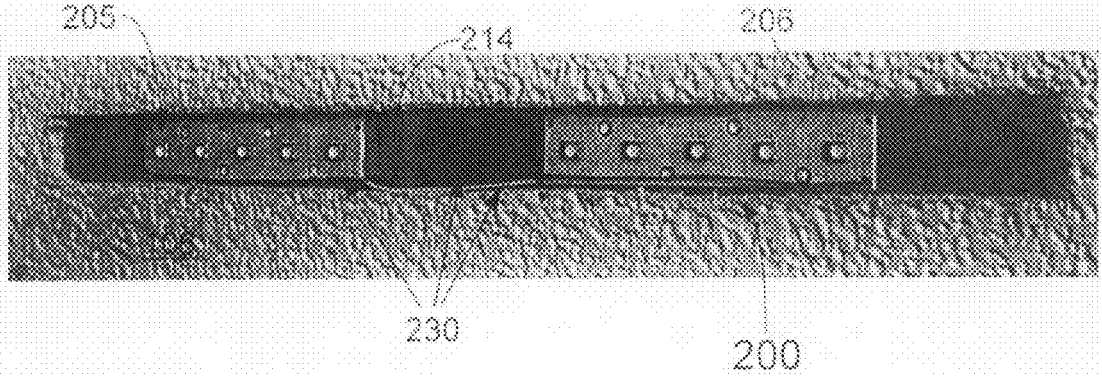
FIG. 6A is a photograph illustrating a prototype LED ceiling tile combination.
Figure 6B:
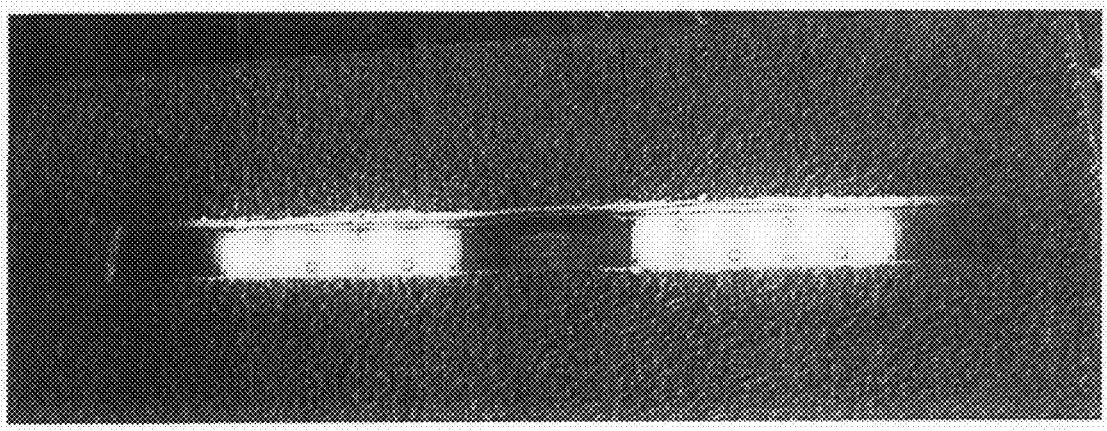
FIG. 6B is a photograph illustrating the prototype LED ceiling tile combination with all LEDs energized.
Figure 6C:
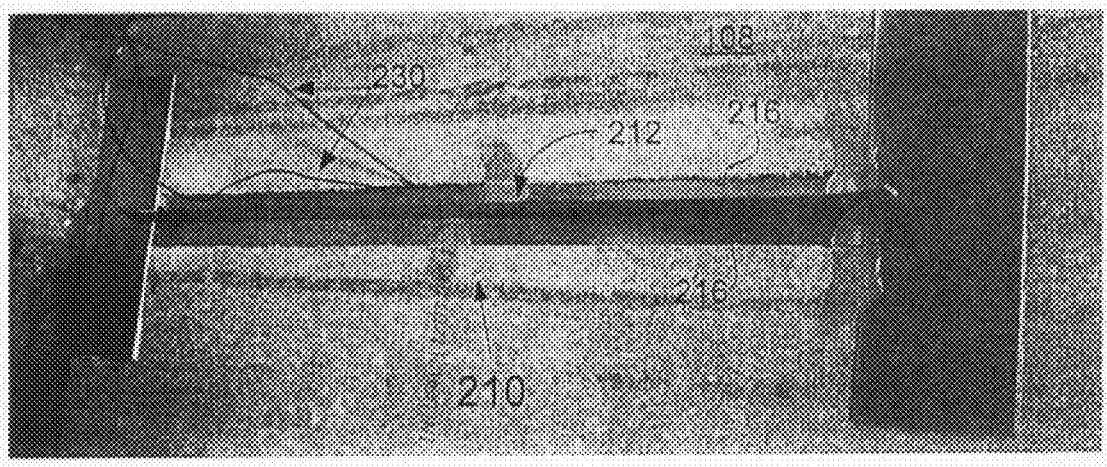
FIG. 6C is a top view of the LED ceiling tile combination in FIGS. 6A and 6B to illustrate the support structure/mount for supporting the LED strip thereon.

FIG. 6A is a photograph illustrating a prototype LED ceiling tile combination, FIG. 6B illustrates the prototype LED ceiling tile combination with all LEDs energized, and FIG. 6C is a top view of the LED ceiling tile combination in FIGS. 6A and 6B to illustrate the support structure/mount for supporting the LED strip 200 thereon.

Referring to FIGS. 6A-6C, the LED strip 200 is generally flush with a facing surface 106 of the ceiling tile 100. In FIG. 6A, there are shown two 5-LED arrays on corresponding MCPCBs 206 which are formed on the horizontal surface 214 of the T-bar. FIG. 6A also illustrates the wires 230 that electrically connect the LED strips 200 to the driver 300 (not shown) on the backside surface 108 of the ceiling tile 100.

FIG. 6C illustrates the mount 210 in further detail. As can be seen in FIG. 6C, the mount 210 comprises the horizontal surface 214 of the T-bar which is bisected by the vertical leg 212 to form two flanges 216 which reside in the opening 202 formed in the LED ceiling tile 100. FIG. 6C also better illustrates the tabs 220 attached to the horizontal surface 214 of the T-bar as well as the vertical leg 212.

The mount 210 can be configured as an integral one-piece part, or an off-the-shelf T-bar can be selected connected to metal tabs 220 by welding, rivets, etc. FIG. 6C also illustrates the wires 230 which electrically connect the LEDs 205 to driver 300 (not shown).

The example embodiments are not limited to a combination LED ceiling tile. In an alternative, the example LED fixture or strip 200 can be integrated with any planar surface having a thickness so that one or more LEDs, groups of LEDs or one or more LED strips 200 are arranged along the same plane of the planar surface which faces a space to illuminate. In an example, the mount or support structure 210 can be removably secured within an opening of the planar surface, so that at least a part of the support structure 210 extends into or through the opening to secure the LED strip to a backside of the planar surface. The aforementioned planar surface can be part of any building material panel as heretofore described. Moreover, the LEDs, groups of LEDs or LED strips 200 can be oriented so as to protrude below or out from the planar surface or recessed with respect to the planar surface, at an angle, and/or adjustable to a desired angle or orientation with respect to the planar surface of the building material panel.

The planar surface having a thickness can be one of a wall, a ceiling and a ceiling tile. For example, LEDs, groups of LEDs or LED strips 200 can be arranged on a standard 4'×8' piece of drywall, plasterboard, wallboard or other materials which are used to make walls or ceilings of interior spaces. In another alternative, the drywall, plasterboard, wallboard, etc can be manufactured and sold with an installed sleeve 400 with or without the driver 300 attached thereto, as shown in FIGS. 3A and 3B for example.

The example embodiments of the present invention being thus described, it will be obvious that the same may be varied in many ways. Such variations are not to be regarded as departure from the spirit and scope of the example embodiments of the present invention, and all such modifications as would be obvious to one skilled in the art are intended to be included within the scope of the following claims.

What is claimed:

1. A combination, comprising:

a ceiling tile having a planar facing surface and a backside surface opposite the planar facing surface, and at least one LED fixture integrated with the ceiling tile so that the fixture is arranged substantially parallel with the ceiling tile planar facing surface, the at least one LED fixture comprising at least one LED strip containing two or more LEDs mounted to the ceiling tile, the LED strip being slidably removable from the ceiling tile in a direction substantially parallel to the planar facing surface for selectively maintaining the two or more LEDs.

2. The combination of claim 1, wherein the ceiling tile includes an opening through which a support structure of the at least one fixture extends to secure the fixture to a backside of the ceiling tile.

3. The combination of claim 2, wherein the opening is sized to the dimensions of the fixture.

4. The combination of claim 1, wherein the at least one fixture comprises at least one LED strip being removably affixed to a support structure, the at least one LED strip including a plurality of serially-connected LEDs thereon.

5. The combination of claim 1, further comprising:

a removable power supply attached to a surface of the ceiling tile for powering the LED fixture.

6. The combination of claim 5, wherein the ceiling tile is supported by tile mounts along edges of the tile, and the fixture and power supply are attached to one of the tile mounts.

7. The combination of claim 1, wherein the LED fixture produces a total light output in a range at least 5,600 lumens.

8. The combination of claim 1, wherein the LED fixture produces a light output per square foot of the ceiling tile of at least 1400 lumens/ft$^2$.

9. The combination of claim 1, wherein the LED fixture produces a total light output in a range of between 5,600 to 18,000 lumens.

10. The combination of claim 1, wherein the LED fixture produces a light output per square foot of the ceiling tile in a range of between 1400 to 2250 lumens/ft$^2$.

11. A combination, comprising:

a ceiling tile having a planar facing surface and a backside surface opposite the planar facing surface, and at least one LED fixture integrated with the ceiling tile so that the fixture is arranged substantially parallel with the ceiling tile planar facing surface, the at least one LED fixture comprising at least one LED strip containing two or more LEDs mounted to the ceiling tile, the LED strip being slidably removable from the ceiling tile for selectively maintaining the two or more LEDs;

wherein the ceiling tile includes an opening through which a support structure of the at least one fixture extends to secure the fixture to a backside of the ceiling tile;

wherein the opening is sized to the dimensions of the fixture; and wherein the support structure comprises a T-bar having a horizontal surface to which the at least one LED fixture is affixed and a vertical leg which extends through the opening and provides a heat spreading function for the fixture.

12. A combination, comprising:

a ceiling tile having a planar facing surface and a backside surface opposite the planar facing surface, and at least one LED fixture integrated with the ceiling tile so that the fixture is arranged substantially parallel with the ceiling tile planar facing surface, the at least one LED fixture comprising at least one LED strip containing two or more LEDs mounted to the ceiling tile, the LED strip being slidably removable from the ceiling tile for selectively maintaining the two or more LEDs;

wherein the at least one fixture comprises at least one LED strip being removably affixed to a support structure, the at least one LED strip including a plurality of serially-connected LEDs thereon; and wherein at least one LED strip is mounted in a sleeve that enables removal and replacement of a given strip in the ceiling tile.

13. The combination of claim 12, wherein the support structure comprises a T-bar having a horizontal surface to which the at least one LED strip is affixed and a vertical leg which provides a heat spreading function for the LED strip, and the sleeve comprises a mount body configured to receive the LED strip slidable therein, the mount body having a slot for receiving the leg of the T-bar on which the LED strip is affixed.

14. A combination, comprising:

a ceiling tile having a planar facing surface and a backside surface opposite the planar facing surface, and at least one LED fixture integrated with the ceiling tile so that the fixture is arranged substantially parallel with the ceiling tile planar facing surface, the at least one LED fixture comprising at least one LED strip containing two or more LEDs mounted to the ceiling tile, the LED strip being slidably removable from the ceiling tile for selectively maintaining the two or more LEDs;

wherein the at least one LED fixture includes:

a mount, and the LED strip removably affixed to the mount, the LED strip including a plurality of serially-connected LEDs thereon, the mount comprising a T-bar having a horizontal surface to which the LED strip is affixed and a vertical leg, the T-bar providing a heat spreading function for the LED strip thereon, the leg bisecting the T-bar to form a horizontal flange on each side of the leg, each flange extending the length of the LED strip and engaging the backside surface of the ceiling tile to secure the LED strip to the ceiling tile.

15. The combination of claim 14, wherein the mount further includes a pair of metal tabs oriented perpendicular to and attached to the leg and horizontal flanges at each end of the T-bar so as to be flush with the backside surface of the ceiling tile.

16. The combination of claim 14, wherein the T-bar is composed of a thermally conductive material.

17. An LED fixture, comprising:

at least one LED strip integrated with a building material panel having a thickness, a planar facing surface, and a backside surface opposite the facing surface, the LED strip being arranged substantially parallel with the planar facing surface, and the at least one LED strip being slidably removable from the building material panel in a direction substantially parallel to the planar facing surface for selectively maintaining the at least one LED strip, and a support structure for the at least one LED strip, the planar facing surface including an opening through which a part of the support structure extends to secure the LED strip to the backside surface of the planar surface.

18. The fixture of claim 17, wherein the building material panel having a thickness is one of a wall, a ceiling and a ceiling tile.

19. The fixture of claim 17, wherein the LED strip produces a total light output in a range at least 5,600 lumens.

20. The fixture of claim 17, wherein the LED strip produces a light output per square foot of the ceiling tile of at least 1400 lumens/ft$^2$.

21. An LED fixture, comprising:

at least one LED strip integrated with a building material panel having a thickness, a planar facing surface, and a backside surface opposite the facing surface, the LED strip being arranged substantially parallel with the planar facing surface, and the at least one LED strip being slidably removable from the building material panel for selectively maintaining the at least one LED strip, and a support structure for the at least one LED strip, the planar facing surface including an opening through which a part of the support structure extends to secure the LED strip to the backside surface of the planar surface;

wherein the support structure comprises:

a T-bar having a horizontal surface to which the at least one LED strip is affixed and a vertical leg bisecting the horizontal surface to form a pair of horizontal flanges which extend the length of the T-bar, the T-bar composed of a thermally conductive material to provide a heat spreading function for the LED strip thereon.

22. The fixture of claim 21, wherein the support structure further includes a pair of metal tabs oriental perpendicular to and attached to the leg and horizontal flanges at each end of the T-bar so as to be flush with the backside surface of the building material panel.

23. An LED fixture, comprising:

at least one LED strip integrated with a building material panel having a thickness, a planar facing surface, and a backside surface opposite the facing surface, the LED strip being arranged substantially parallel with the planar facing surface, and the at least one LED strip being slidably removable from the building material panel for selectively maintaining the at least one LED strip, and a support structure for the at least one LED strip, the planar facing surface including an opening through which a part of the support structure extends to secure the LED strip to the backside surface of the planar surface;

wherein the at least one LED strip includes a plurality of serially-connected LEDs thereon and is mounted on a sleeve contained on the building material panel that enables removal and replacement of the LED strip on the building material panel.

24. The fixture of claim 23, wherein the support structure comprises a T-bar having a horizontal surface to which the at least one LED strip is affixed and a vertical leg which provides a heat spreading function for the LED strip, and the sleeve comprises a mount body configured to receive the LED strip slidable therein, the mount body having a slot for receiving the leg of the T-bar on which the LED strip is affixed.

25. A ceiling tile, comprising:

a panel having one of a generally rectangular or square shape, the panel having a thickness, a facing surface and a backside surface and at least one opening formed through its thickness, and at least one LED strip integrated with the ceiling tile so that the LED strip is arranged substantially parallel with the ceiling tile facing surface, the at least one LED strip being slidably removable from the ceiling tile in a direction substantially parallel to the planar facing surface for selectively maintaining the at least one LED strip.

26. The ceiling tile of claim 25, wherein the at least one LED strip secured to the ceiling tile backside surface.

27. The ceiling tile of claim 25, wherein the opening is sized to the dimensions of the at least one LED strip.

28. The ceiling tile of claim 27, further comprising a support structure affixed to the LED strip for securing the at least one LED strip to the ceiling tile.

29. The ceiling tile of claim 25, further comprising:

a removable power supply attached to the backside surface of the panel for powering the at least one LED strip.

30. The ceiling tile of claim 29, wherein the ceiling tile is supported by tile mounts along edges of the tile, and the at least one LED strip and power supply are attached to one of the tile mounts.

31. A ceiling tile, comprising:

a panel having one of a generally rectangular or square shape, the panel having a thickness, a facing surface and a backside surface and at least one opening formed through its thickness;

at least one LED strip integrated with the ceiling tile so that the LED strip is arranged substantially parallel with the ceiling tile facing surface, the at least one LED strip being slidably removable from the ceiling tile for selectively maintaining the at least one LED strip; and a support structure affixed to the LED strip for securing the at least one LED strip to the ceiling tile;

wherein the opening is sized to the dimensions of the at least one LED strip; and wherein the support structure includes a T-bar having a horizontal surface to which the at least one LED strip is affixed and a vertical leg which extends through the opening and provides a heat spreading function for the LED strip thereon.

32. A ceiling tile, comprising:

a panel having one of a generally rectangular or square shape, the panel having a thickness, a facing surface and a backside surface and at least one opening formed through its thickness, and at least one LED strip integrated with the ceiling tile so that the LED strip is arranged substantially parallel with the ceiling tile facing surface, the at least one LED strip being slidably removable from the ceiling tile for selectively maintaining the at least one LED strip;

wherein the at least one LED strip includes a plurality of serially-connected LEDs thereon and is mounted in a sleeve contained on the panel that enables removal and replacement of the LED strip on the panel.

33. The ceiling tile of claim 32, further comprising a T-bar having a horizontal surface to which the at least one LED strip is affixed and a vertical leg which provides a heat spreading function for the LED strip, wherein the sleeve comprises a mount body configured to receive the LED strip slidable therein, the mount body having a slot for receiving the leg of the T-bar on which the LED strip is affixed.

34. A ceiling tile, comprising:

a panel having one of a generally rectangular or square shape, the panel having a thickness, a facing surface and a backside surface and at least one opening formed through its thickness, a sleeve affixed within the opening on the facing surface of the panel, the sleeve having a power connector at an end thereof and configured to receive an LED strip therein, and a removable power supply attached to power connector.

35. The ceiling tile of claim 34, wherein an LED strip is slidable into a fixed position within the sleeve, the LED strip having a power connector which mates with the power connector at the sleeve end to electrically connect the power supply to the LED strip.

36. A combination, comprising:

a ceiling tile having a planar facing surface and a backside surface opposite the planar facing surface; and at least one LED fixture integrated with the ceiling tile so that the fixture is arranged substantially parallel with the ceiling tile planar facing surface;

wherein the ceiling tile includes an opening through which a support structure of the at least one fixture extends to secure the fixture to a backside of the ceiling tile, and wherein the support structure comprises a T-bar having a horizontal surface to which the at least one LED fixture is affixed and a vertical leg which extends through the opening and provides a heat spreading function for the fixture.

37. A combination, comprising:

a ceiling tile having a planar facing surface and a backside surface opposite the planar facing surface; and at least one LED fixture integrated with the ceiling tile so that the fixture is arranged substantially parallel with the ceiling tile planar facing surface;

wherein the at least one fixture comprises at least one LED strip removably affixed to a support structure, the at least one LED strip including a plurality of serially-connected LEDs thereon, and wherein at least one LED strip is mounted in a sleeve that enables removal and replacement of a given strip in the ceiling tile.

38. The combination of claim 37, wherein the support structure comprises a T-bar having a horizontal surface to which the at least one LED strip is affixed and a vertical leg which provides a heat spreading function for the LED strip, and the sleeve comprises a mount body configured to receive the LED strip slidable therein, the mount body having a slot for receiving the leg of the T-bar on which the LED strip is affixed.

39. A combination, comprising:

a ceiling tile having a planar facing surface and a backside surface opposite the planar facing surface; and at least one LED fixture integrated with the ceiling tile so that the fixture is arranged substantially parallel with the ceiling tile planar facing surface;

wherein the at least one LED fixture includes:

a mount, and an LED strip removably affixed to the mount, the LED strip including a plurality of serially-connected LEDs thereon, the mount comprising a T-bar having a horizontal surface to which the LED strip is affixed and a vertical leg, the T-bar providing a heat spreading function for the LED strip thereon, the leg bisecting the T-bar to form a horizontal flange on each side of the leg, each flange extending the length of the LED strip and engaging the backside surface of the ceiling tile to secure the LED strip to the ceiling tile.

40. The combination of claim 39, wherein the mount further includes a pair of metal tabs oriented perpendicular to and attached to the leg and horizontal flanges at each end of the T-bar so as to be flush with the backside surface of the ceiling tile.

41. The combination of claim 39, wherein the T-bar is composed of a thermally conductive material.

42. An LED fixture, comprising:

at least one LED strip integrated with a building material panel having a thickness, a planar facing surface, and a backside surface opposite the facing surface, the LED strip being arranged substantially parallel with the planar facing surface; and a support structure for the at least one LED strip, the planar facing surface including an opening through which a part of the support structure extends to secure the LED strip to the backside surface of the planar surface, wherein the support structure comprises a T-bar having a horizontal surface to which the at least one LED strip is affixed and a vertical leg bisecting the horizontal surface to form a pair of horizontal flanges which extend the length of the T-bar, the T-bar composed of a thermally conductive material to provide a heat spreading function for the LED strip thereon.

43. The fixture of claim 42, wherein the support structure further includes a pair of metal tabs oriental perpendicular to and attached to the leg and horizontal flanges at each end of the T-bar so as to be flush with the backside surface of the building material panel.

44. An LED fixture, comprising:

at least one LED strip integrated with a building material panel having a thickness, a planar facing surface, and a backside surface opposite the facing surface, the LED strip being arranged substantially parallel with the planar facing surface; and a support structure for the at least one LED strip, the planar facing surface including an opening through which a part of the support structure extends to secure the LED strip to the backside surface of the planar surface;

wherein the at least one LED strip including a plurality of serially-connected LEDs thereon and is mounted on a sleeve contained on the building material panel that enables removal and replacement of the LED strip on the building material panel.

45. The fixture of claim 44, wherein the support structure comprises a T-bar having a horizontal surface to with the at least one LED strip Is affixed and a vertical leg which provides a heat spreading function for the LED strip, and the sleeve comprises a mount body configured to receive the LED strip slidable therein, the mount body having a slot for receiving the leg of the T-bar on which the LED strip is affixed.

46. A ceiling tile, comprising:

a panel having one of a generally rectangular or square shape, the panel having a thickness, a facing surface and a backside surface and at least one opening formed through its thickness, wherein the opening is sized to the dimensions of the at least one LED strip;

at least one LED strip integrated with the ceiling tile so that the LED strip is arranged substantially parallel with the ceiling tile facing surface; and a support structure affixed to the LED strip for securing the at least one LED strip to the ceiling tile, the support structure including a T-bar having a horizontal surface to which the at least one LED strip is affixed and a vertical leg which extends through the opening and provides a heat spreading function for the LED strip thereon.

47. A ceiling tile, comprising:

a panel having one of a generally rectangular or square shape, the panel having a thickness, a facing surface and a backside surface and at least one opening formed through its thickness; and at least one LED strip integrated with the ceiling tile so that the LED strip is arranged substantially parallel with the ceiling tile facing surface;

wherein the at least one LED strip includes a plurality of serially-connected LEDs thereon and is mounted in a sleeve contained on the panel that enables removal and replacement of the LED strip on the panel.

48. The ceiling tile of claim 47, further comprising a T-bar having a horizontal surface to which the at least one LED strip is affixed and a vertical leg which provides a heat spreading function for the LED strip, wherein the sleeve comprises a mount body configured to receive the LED strip slidable therein, the mount body having a slot for receiving the leg of the T-bar on which the LED strip is affixed.

49. A ceiling tile, comprising:

a panel having one of a generally rectangular or square shape, the panel having a thickness, a facing surface and a backside surface and at least one opening formed through its thickness;

at least one LED strip integrated with the ceiling tile so that the LED strip is arranged substantially parallel with the ceiling tile facing surface, the LED strip being slidably removable from the ceiling tile in a direction substantially parallel to the facing surface; and a removable power supply attached to the backside surface of the panel for powering the at least one LED strip;

wherein the ceiling tile is supported by tile mounts along edges of the tile, and the at least one LED strip and power supply are attached to one of the tile mounts.

* * * * *